US005553187A

United States Patent [19]

Lippo

[11] Patent Number: 5,553,187

[45] Date of Patent: Sep. 3, 1996

[54] BOOSTER MECHANISM FOR SAUNA GENERATOR'S ROCKPILE UTILIZING WATER-DIRECTING BYPASS STRUCTURE

[76] Inventor: Veikko A. Lippo, 15101 Interlachen Dr., Apt. 606, Silver Spring, Md. 20906

[21] Appl. No.: 253,265

[22] Filed: Jun. 2, 1994

[51] Int. Cl.[6] ..... F22B 1/28; H05B 1/00

[52] U.S. Cl. ..... 392/342; 392/394; 4/524

[58] Field of Search ..... 392/342, 394, 392/403, 405; 4/524, 528–532

[56] References Cited

U.S. PATENT DOCUMENTS

| | | | |
|---|---|---|---|
| 2,512,892 | 6/1950 | Forsberg . | |
| 3,110,797 | 11/1963 | Vanne et al. | 4/524 |
| 3,364,336 | 1/1966 | Lippo . | |
| 3,372,264 | 3/1968 | Williams | 4/524 |
| 3,400,248 | 9/1968 | Isomaa | 4/524 |

FOREIGN PATENT DOCUMENTS

| | | | |
|---|---|---|---|
| 3404892 | 8/1985 | Germany | 4/524 |
| 561050 | 7/1977 | U.S.S.R. | 4/524 |
| 966397 | 10/1982 | U.S.S.R. | 4/524 |

*Primary Examiner*—John A. Jeffery

[57] ABSTRACT

This invention is for boosting the performance of any existing rockpile-type sauna generator by dividing the rockpile to two parts, the lower part for steam generation and the upper part for steam drying and superheating. The parts are separated from each other by an enclosed space, clear of rocks, which allows water to spread out onto a large area of the rocks at the lower part the rockpile and steam to expand into a large space below the top part of the rockpile and thus to touch a large volume of hot rocks when it rises through the rockpile. Water is transported down to the space above the bottom part of the rockpile without touching the hot rocks at the top of the rockpile, by using bypassers which allow water to run down past the upper part of the rockpile and to spread out over a large area of rocks at lower part of the rockpile. Various types of bypassers are formed by narrow channels and or pipes, embedded into the top part of the rockpile, with funnels or cups at their tops for inserting water, and spouts or distribution tubes at their bottoms for spreading water. A grid, wire-net cage or a similar structure is placed between the rockpile layers to create an enclosed space clear of rocks for water to spread out and for steam to expand.

3 Claims, 3 Drawing Sheets

BOOSTER MECHANISM FOR SAUNA GENERATOR'S ROCKPILE UTILIZING WATER-DIRECTING BYPASS STRUCTURE

Following references are on file for this patent: U.S. Patents:

| U.S. Pat. No. | Name | Date |
|---|---|---|
| 2,512,892 | Forsberg | June 27, 1950 |
| 3,364,336 | Lippo | January 30, 1966 |

BACKGROUND OF THE INVENTION

This invention relates to the Finnish sauna-bath or more properly the sauna, which is a form of exposure of one's body in an enclosed space to a special atmosphere of air and water at temperatures much beyond body temperature.

According to the ancient Finnish practice of sauna, small rocks are oiled in special manner, an art which is fast becoming lost, after which a wood fire is burned for hours under the rocks until they become heated to a temperature ranging between 600 F. and 1000 F. The fire is then extinguished and a measured amount of water is thrown on the rockpile.

The rocks are so arranged that most of the water rapidly reaches the bottom layers. These bottom layers are arranged to arrest the flow of water so that here the bulk of water is rapidly turned to steam. The heap of rocks is arranged to impede the free escape of the steam so that the steam, by contact with the highly heated rocks, is superheated as it rises.

The superheated expanding steam mixes with the hot dry air in and about the rockpile, creating a surge of air and steam in the sauna room. This mixture of air and superheated steam generated in a sudden surge is known by a Finnish word 'loyly'; the English language has no correspondent equivalent term.

The loyly generator constructed from rocks generates proper loyly only if the temperature of the rocks is approximately 600 F. or higher. Steam which is generated at lower temperatures is not sufficiently superheated to have the same effect on a bather's body as proper loyly.

Many steam generators have been produced, mostly electricity powered, which do not generate superheated, dry steam, and therefore are not loyly generators. Nevertheless they are misleadingly marketed as 'sauna heaters'. They are in effect wet steam or hot air generators, incapable of producing the loyly that characterizes a true Finnish sauna. They are not able of generating superheated, dry steam because their rockpile is very low.

Many of these units could be made to produce true loyly by pouring water on top of the rocks if: (a) their rockpile height would be increased to at least 16inches; (b) the heating time would be increased to at least 6 hours; and (c) the heating capacity would be increased to at least 15 kw. Such units, however, are impractical and uneconomical.

A rockpile height of 12 inches is a borderline —below it true loyly cannot be produced, above it the rockpile heating becomes impractical in terms of both time and power required. At around 12 inches height however, loyly can be produced by one or more of the means described in this invention with a reasonable heating capacity (6–10 kw) in a reasonable heating time (2–4 hours).

The rockpile frames for most presently marketed sauna generators are shallow round, square or rectangular containers which are filled with rocks. A heat source (a wood fire, electric elements or gas flame) is installed below the rockpile to produce hot gases which supply heat to the rocks.

If water is poured on top of these rockpiles, most of the water turns to steam on the surface of the rocks at the very top of the rockpile. This action is undesirable because it cools the top rocks so that the generated steam is too wet to form true sauna loyly and if the rockpile is not high enough, the remaining water sinks through the entire rockpile without ever becoming steam.

In all sauna generators in which water is poured or thrown onto a rockpile, rising steam touches the hot rocks and expands forming a tornado-like cone. This is an inherent property of steam rising through heated rocks. The volume of the cone increases exponentially with increases in the height of the cone. In a 4-inch rockpile, the volume of the cone may be noticeably less than 20 cubic inches, while in a 12-inch rockpile the volume increases to approximately 500 cubic inches, and in 16-inch rockpile to well over 1000 cubic inches. The volume of this steam cone is a direct measure of the generator's ability to generate loyly.

If water could be spread out near the bottom of the rockpile over a horizontal area the size of the top of the cone, the volume of hot rocks touched by the rising steam may be increased several times over the volume of rocks touched by a cone-like formation. The capacity to generate superheated, dry steam, therefore, would be increased correspondingly if the steam would be expanded to a larger space below the rockpile before it rises up through the hot rockpile.

BRIEF SUMMARY OF THE INVENTION

The present invention is for several independent yet complementary means to achieve this desired result by an extension of the existing sauna generator's rockpile and its frame, mechanism to supply water directly to the lower section of the rockpile bypassing the rocks at the top section, mechanism to spread water over a large horizontal area at the lower section of the rockpile, and mechanism to expand the generated steam into a large space below the top section of the rockpile before it travels up through the top part of the rockpile, drying and superheating.

ADVANTAGES OF THE INVENTION

The extension of the rockpile has an advantage of increasing the length of the path which steam will travel when rising through the rockpile. The expansion of the frame enclosing the rockpile has an advantage of improving steam generation by providing space for water to spread out over a large area, and providing space for generated steam to expand and to spread out into a large space below the hot part of the rockpile before it travels up through the rockpile, drying and superheating.

Supplying water to the lower section of the rockpile has an advantage of bypassing the rocks at the upper section of the rockpile and also preventing cooling of the rocks in that section.

Spreading water out over a large area at the lower section of the rockpile has an advantage of making the water generate steam by touching a large area of rocks instead of only the area where water was poured into the rockpile.

Expanding steam over a large horizontal space below the top section of the rockpile has the advantage of making the steam touch a much larger area of hot rock surfaces as it rises. The generator's steam drying and superheating capacity is magnified in direct proportion to the additional number of rocks touched by the rising steam.

OBJECTS OF THE INVENTION

The primary object of this invention is to provide a unique means to boost the rockpile's ability to dry and to superheat steam, such that an improved, true sauna bath can be achieved with presently available sauna generators within a reasonable heating time without increasing power requirements.

The further object of the present invention is to lower the manufacturing costs of sauna generators by making it possible to decrease the size of generators without decreasing the dryness and temperature of the generated steam.

The further object of the present invention is to reduce the operating costs of sauna generators by reducing the amount and/or temperature of rocks to be heated without reducing the dryness or temperature of the generated steam.

EXECUTION OF THE INVENTION

The execution of this invention depends upon which portions of the invention are incorporated into an existing sauna generator; because they are complementary yet independent, either some or all portions of the invention may be used in any given application.

In the event of incorporation of all aspects of this invention, its execution requires modification of the top of any existing sauna generator by construction of a three-layered booster within a single enclosed compartment with openings only at the top and bottom. First, an adapter covers and encloses the existing rockpile, permits additional rocks to be added and permits the addition of an upper booster structure which contains an additional rockpile, held by a grid with large holes. The third layer (contained between the two layers just described) is an empty space between the rockpile inside the adapter and additional rockpile in upper part of the booster. The upper structure of the booster is fitted with "bypassers" of various types, which are devices embedded into the booster's top rockpile to transport water from the top of the rockpile down to the bottom (that is, water will bypass without touching the hot rocks along the way) and to distribute this water over a large area of the rockpile in the empty space provided under the top rockpile. Such bypassers may be used with or without the three-layer structure described above (that is, they may be incorporated into any single-layer rockpile as well) to transport water to rocks located lower down in the single rockpile.

OPERATION OF THE INVENTION

The booster is operated by pouring into the bypassers the same amount of water which would be poured into the rockpile of any sauna generator without a booster. The water then runs through the bypassers, spreads out to the empty space under the upper rockpile and sinks into the lower rockpile. There it becomes steam, rises back to the empty space between the upper and lower rockpiles, expands within this area, and travels through the hot upper rockpile touching rocks along the way. As a result the steam absorbs heat energy, heats up even further, thereby becomes dried and superheated loyly. A somewhat less effective—but nevertheless improved—result is achieved by using bypassers with a single-layer rockpile.

BRIEF DESCRIPTION OF THE DRAWINGS

The objects and advantages of this invention may be fully understood from the following description of certain specific embodiments of this invention in conjunction with the accompanying drawings, wherein.

DETAILED DESCRIPTION OF THE INVENTION

Figure 1:
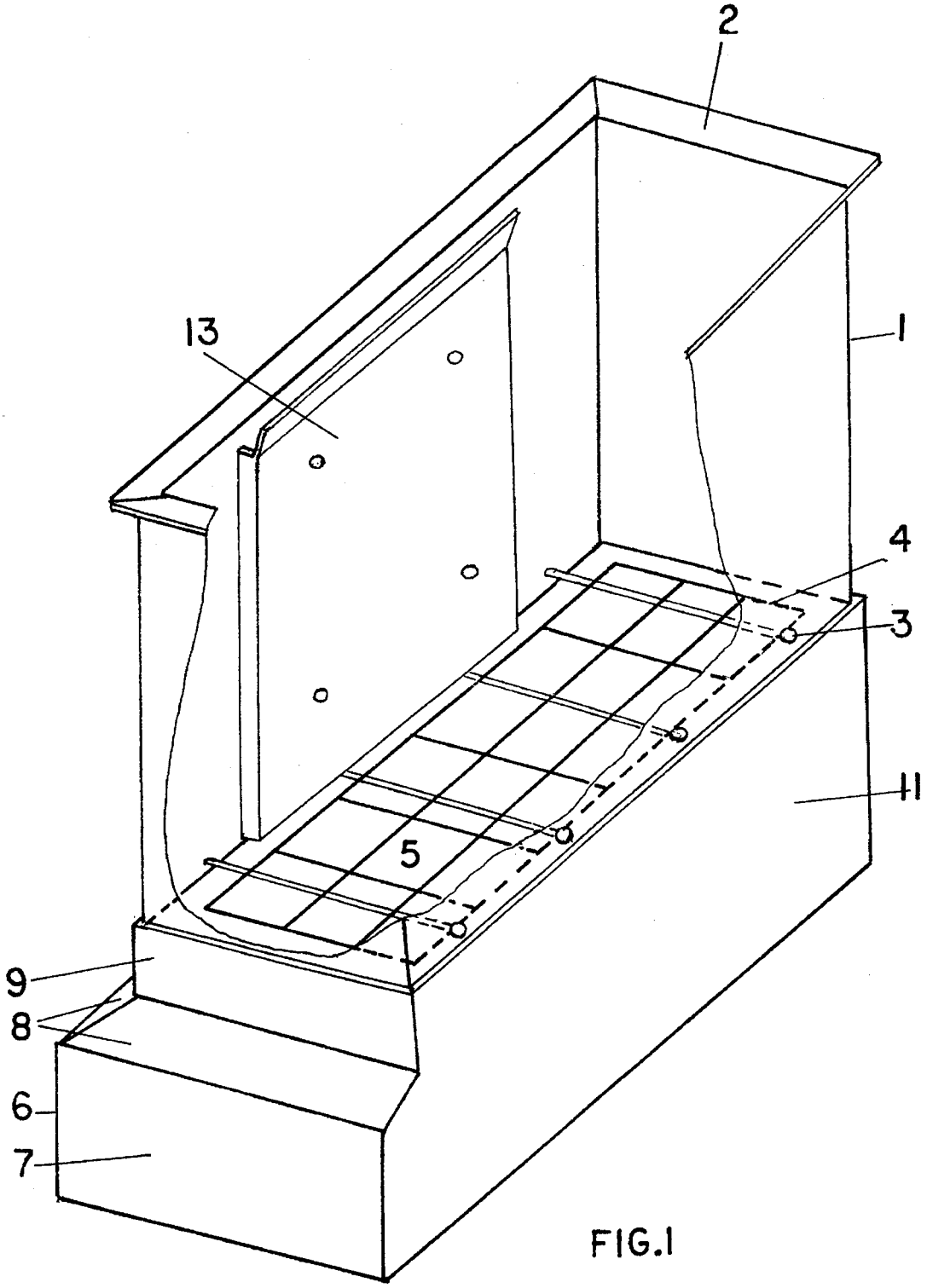
FIG. 1 is a more or less conventional perspective view of the booster with two sloping walls and a basic bypasser plate.
Figure 2:
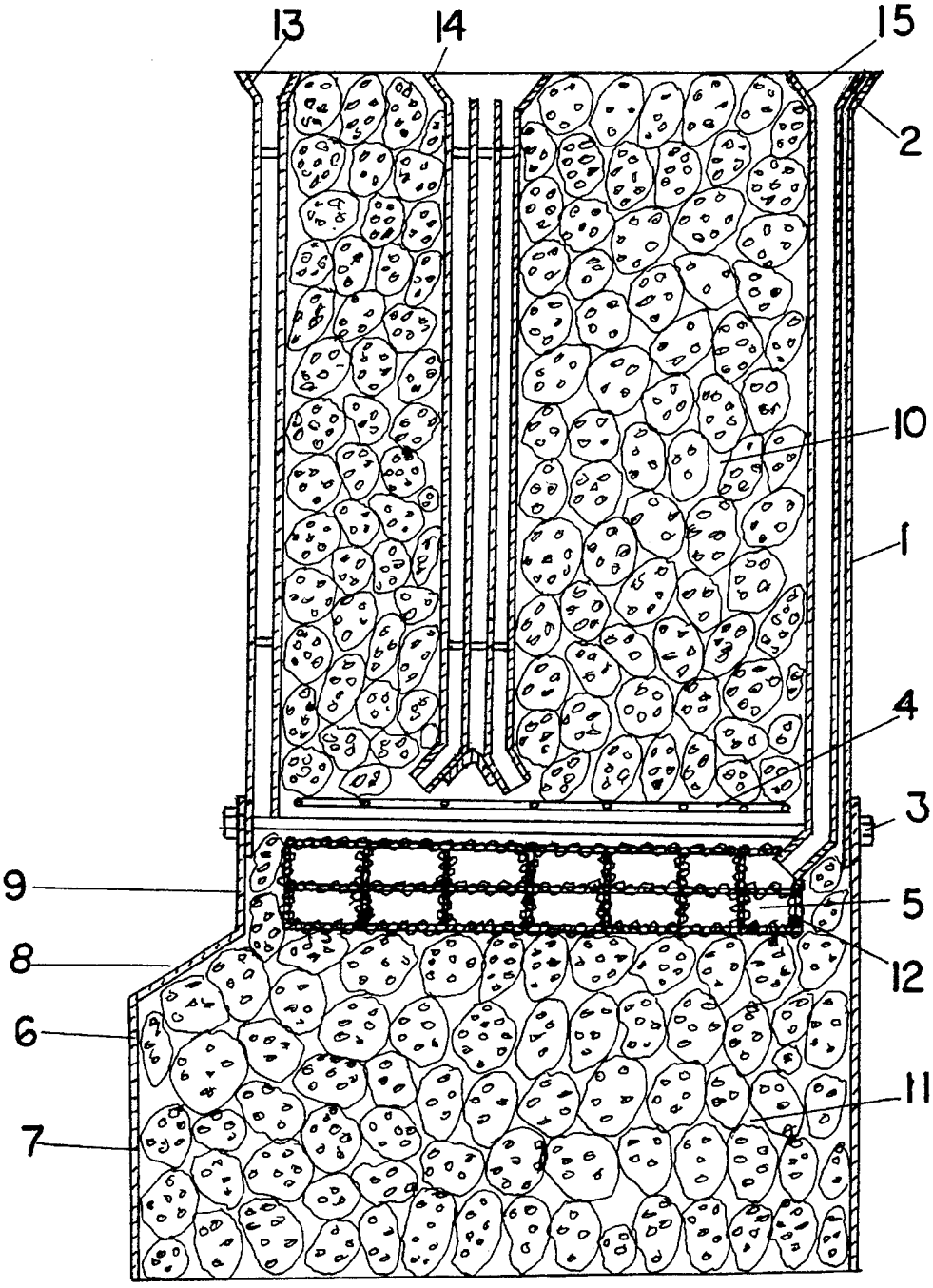
FIG. 2 is a side elevation of the booster with three types of bypassers embedded into its rockpile.

Referring to FIGS. 1–2, the booster mechanism here disclosed is comprised of an upper structure made of sheet metal, filled with rocks with vertical walls (1) with outward bent tops (2), reinforced against expansion by crossover bolts (3) at the lower part of the structure, filled with rocks, with a horizontal grid (4) laid on top of the bolts for holding up the rocks, a space (5) under the grid for water to spread out over a large area and for steam to expand to the space under the booster's upper rockpile, and an adapter structure (7) made of sheet metal, with vertical lower walls (6) which fit onto the existing sauna generator, with center walls (8) of which one or more slope inward, and with vertical top walls (9) which fit and are fastened to the outside of the upper booster structure. The amount of slope of the center walls of the adapter structure may vary depending on the type of the existing sauna generator. Rocks fill the space (10) above the grid in the upper structure of the booster for steam drying and superheating, and the space (11) below the top edge of the sloping center walls of the adapter structure for steam generation. A bypasser plate (13) is fastened to the wall in the upper booster structure leaving a narrow passage for water to run through the upper rockpile without touching the hot rocks. A similar bypasser plate could be attached to any wall of the upper booster structure. A wire-net cage (12A) or a similar structure may be placed into the space between the grid and the lower rockpile in the adapter to keep the space clear of rocks. The space inside the cage is empty. Three different type of bypassers (13, 14, 15) are shown in FIG. 2 embedded into the upper rockpile.

Figure 3:
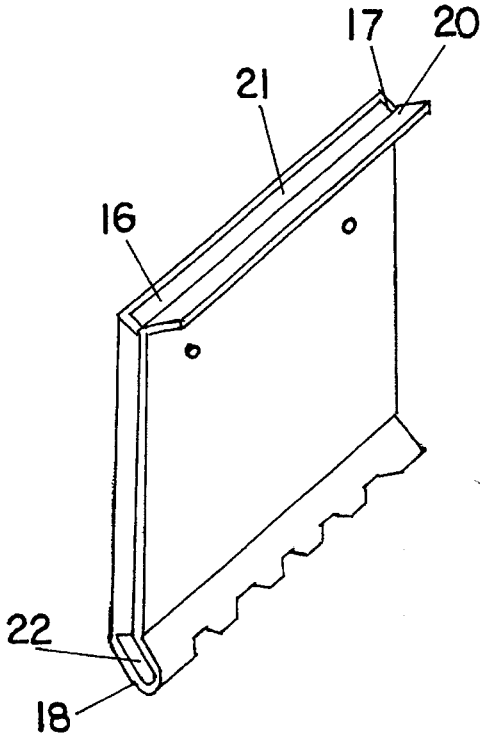
FIG. 3 is a perspective view of a single pocket-type bypasser.

Referring to FIG. 3, a bypasser is formed by a sheet metal plate to form a pocket (16), the sides (17) are closed and the bottom is bent to form a spout (18) with wide holes (19) at the tip. The pocket reaches from the top of the rockpile down to the grid. One of the top edges (20) is bent forming a funnel (21) for recipt of water, and the walls form a narrow space (22) for water to run down bypassing hot rocks in the upper portion of the rockpile.

Figure 4:
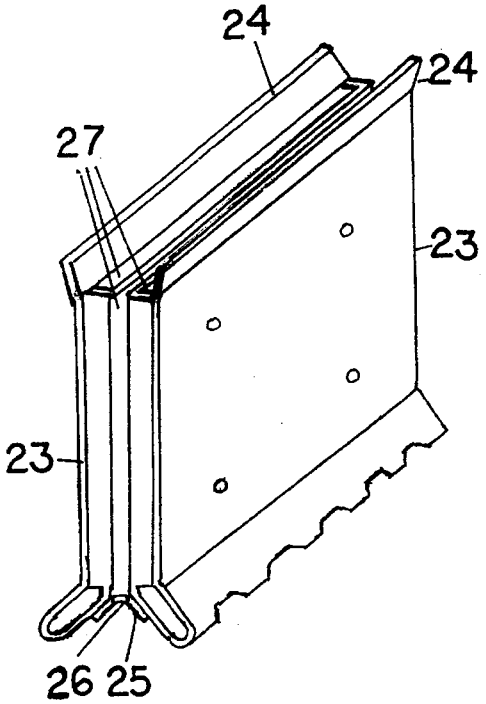
FIG. 4 is a perspective view of two pocket-type bypassers bolted together.

Referring to FIG. 4, two pocket-like bypassers (23) are bolted together with tops (24) bent outward, a floor (25) with large holes (26) between them. The water poured on top of the bypasser runs through three narrow passages (27), runs out from their bottom through the grid spreading over the rocks at the bottom section of the rockpile.

Insofar as various modifications are applicable to other forms described, they may be used either individually or collectively, either partially or wholly. For example, the empty space in the middle of the rockpile created by separating the top and bottom parts by a grid, as in FIGS. 1–2, or by inserting a cage, as in FIG. 2, can be used in any electric or wood burning sauna generator with or without the booster structure as illustrated in FIGS. 1–2. Alternatively, the grid or the cage or both can be excluded if bypassers with the cage are used.

While I have shown and described certain specific embodiments of my invention, it will be understood that this is by way of illustration and various changes and modifications may be made within the contemplation of my invention and under the scope of the following claims:

I claim:

1. Apparatus for increasing the dryness and temperature of steam generated by rockpile type sauna generators, comprised of a single enclosed compartment with openings only at the top and bottom of said compartment, two layers of rocks inside said enclosed compartment, and an empty space between said layers of rocks inside said enclosed compartment with: (a) a first horizontal grid or net as a floor holding the lower layer of rocks for steam generation, with large holes to permit hot gases from the sauna generator to rise through the rocks, (b) a second horizontal grid in the middle of said enclosed compartment holding the upper layer of rocks for steam drying and superheating, said second horizontal grid having large holes to permit gases to rise therethrough, (c) an empty space, clear of rocks, under the upper grid between the rockpile layers for water to spread out over a large area over the rocks in the lower layer of the rockpile and for steam to expand to a wide space under the rocks in the upper layer, and (d) one or more bypasser plates fastened to the walls of said enclosed compartment forming narrow bypassing passages between the walls of said enclosed compartment and the plates to allow water poured on top of the rockpile to run from the top of the rockpile through the rocks in the upper layer of the rockpile down to the space between the rockpile layers and on top of the rocks in the lower layer of the rockpile without touching the hot rocks in the upper layer.

2. Apparatus for increasing the dryness and temperature of steam generated by rockpile type sauna generators, as defined in claim 1, wherein additional bypassing means are created for water poured on top of the rockpile to bypass the hot rocks at the top layer of the rockpile, comprising four plates bolted together with a narrow space between said plates, the top edges of the two outmost plates bent outwards to form a funnel, the bottom of the space between the plates in the center closed by a floor with holes in said floor and the bottom edges of the plates in the center bent outwards leaving a narrow gap between the bottom of the outmost plate and the center plate to form spouts with holes at the tip of the spouts, the total structure embedded into the top layer of the rockpile, or wire-net cage reaching from the top of the rockpile down to the bottom of the top layer of the rocks, forming a funnel at the top of said bypassing means for entering water, three narrow passages disposed in the middle of the top layer of the rockpile for water to run down through said top layer of the rockpile without touching the rocks, and spouts at the bottom of the top layer of rocks for spreading water over the rocks at the bottom layer of the of the rockpile.

3. Apparatus for increasing the dryness and temperature of steam generated by rockpile type sauna generators, wherein: (a) a wire-net cage with large holes is embedded into the rockpile, surrounded by rocks on all sides, thereby forming inside the rockpile an enclosed space, clear of rocks, and (b) a bypassing structure is embedded into the top part of the rockpile, said bypassing structure consisting of a funnel at the top, two vertical walls reaching from the top of the rockpile down to said space, with a narrow gap between said walls, and with spouts with holes at the bottom edge of said walls, such that water poured into the top of said bypassing structure will spout out from the bottom of said bypassing structure into the space inside the cage and over the rocks at the lower part of the rockpile and the steam will expand to the space inside the cage before rising through the upper part of the rockpile, thereby causing the bottom part of the rockpile to generate steam, and the top part of the rockpile to dry and superheat the steam as it rises through the rockpile.

* * * * *